US006582097B2

(12) United States Patent
Chang

(10) Patent No.: US 6,582,097 B2
(45) Date of Patent: Jun. 24, 2003

(54) MULTI-FUNCTION HANDHELD DEVICE FOR OUTDOOR USE

(76) Inventor: Gin-Sung Chang, No. 15, Lane 385, Kuang-Ming Rd., Wu-Jih Hsiang, Taichung Hsien (TW)

( * ) Notice: Subject to any disclaimer, the term of this patent is extended or adjusted under 35 U.S.C. 154(b) by 0 days.

(21) Appl. No.: 09/991,069

(22) Filed: Nov. 15, 2001

(65) Prior Publication Data

US 2003/0058646 A1 Mar. 27, 2003

(51) Int. Cl.[7] ..... F21V 33/00

(52) U.S. Cl. ..... 362/253; 362/196; 362/200; 362/201

(58) Field of Search ..... 362/253, 196, 362/200, 201

(56) References Cited

U.S. PATENT DOCUMENTS 5,826,534 A * 10/1998 Huang ..... 116/137 R
5,956,985 A * 9/1999 Chang ..... 116/DIG. 1
5,975,007 A * 11/1999 Cross ..... 116/137 R

* cited by examiner

*Primary Examiner*—Sandra O'Shea
*Assistant Examiner*—Mark Tsidulko
(74) *Attorney, Agent, or Firm*—Ladas & Parry

(57) ABSTRACT

A multi-function handheld device includes a casing unit, a torch unit, a mirror piece, a magnifying lens piece, a thermometer, and a compass. The casing unit includes lower and upper casing members. Rear casing parts of the casing members cooperatively confine an air inlet. The rear casing part of the lower casing member is further formed with an air outlet to permit generation of a whistling sound output. Front casing parts of the casing members are spaced apart so as to define a receiving slit for mounting the mirror and lens pieces pivotally therein. The casing unit further has receiving cavities for mounting the thermometer and the compass respectively therein. The torch unit is mounted in torch receiving chamber of the front casing part of the upper casing member, and includes a press member that is operable to make electrical connection between a lamp member and a battery set.

14 Claims, 6 Drawing Sheets

MULTI-FUNCTION HANDHELD DEVICE FOR OUTDOOR USE

BACKGROUND OF THE INVENTION

1. Field of the Invention

The invention relates to a handheld device, more particularly to a multi-function handheld device for outdoor use.

2. Description of the Related Art

Generally, when participating in an outdoor activity, such as camping or mountain climbing, articles such as flashlights, whistles, compasses, etc., have to be prepared for safety reasons. However, these articles are easily misplaced and are inconvenient to store. U.S. Pat. No. 5,956,985 discloses a multi-function key holder that incorporates a whistle, a magnifying lens, a thermometer and a compass. It is desirable to provide a handheld device that incorporates a larger number of functions without involving a substantial increase in its dimensions.

SUMMARY OF THE INVENTION

Therefore, the main object of the present invention is to provide a multi-function handheld device for outdoor use that incorporates a whistle, a torch unit, a mirror piece, a magnifying lens piece, a thermometer and a compass.

According to the present invention, a multi-function handheld device comprises a casing unit, a torch unit, a planar mirror piece, a planar magnifying lens piece, a thermometer, and a compass. The casing unit includes a lower casing member and an upper casing member mounted on top of the lower casing member. Each of the lower and upper casing members has a rear casing part and a front casing part that extends forwardly from the rear casing part in a longitudinal direction. The rear casing parts of the lower and upper casing members cooperatively confine an air chamber, and have rear ends that are distal to the front casing parts and that cooperatively define an air inlet in the longitudinal direction so as to be adapted to permit blowing of air into the air chamber. The rear casing part of the lower casing member is further formed with an air outlet that is disposed transverse to the longitudinal direction and that is adapted to permit releasing of the air that was blown into the air chamber, thereby permitting generation of a whistling sound output. The front casing part of the upper casing member is formed with a torch receiving chamber. The front casing parts of the upper and lower casing members are parallel to each other, and are spaced apart in the transverse direction so as to define a receiving slit therebetween. The front casing part of one of the upper and lower casing members is formed with a mounting socket that is registered with the receiving slit, whereas the front casing part of the other one of the upper and lower casing members is formed with a pivot stub that engages the mounting socket. The casing unit further has an outer wall surface formed with a thermometer receiving cavity and a compass receiving cavity. The torch unit is disposed in the torch receiving chamber, and includes a battery set, a lamp member, and a press member. The battery set has a first battery terminal and a second battery terminal opposite to the first battery terminal. The lamp member has a first lamp terminal in electrical contact with the first battery terminal, and a second lamp terminal that extends adjacent to and that is normally spaced apart from the second battery terminal. The press member is mounted on the front casing part of the upper casing member, and is operable so as to urge the second lamp terminal to contact the second battery terminal, thereby making electrical connection between the second lamp terminal and the second battery terminal. The planar mirror piece is disposed in the receiving slit, and has a peripheral frame portion mounted pivotally on the pivot stub. The planar magnifying lens piece is disposed in the receiving slit parallel to the mirror piece, and has an edge portion mounted pivotally on the pivot stub. Each of the mirror piece and the lens piece is movable between a concealed position and an exposed position. In the concealed position, a corresponding one of the mirror piece and the lens piece is confined between the front casing parts of the upper and lower casing members. In the exposed position, the corresponding one of the mirror piece and the lens piece is exposed from the front casing parts of the upper and lower casing members. The thermometer is mounted securely in the thermometer receiving cavity. The compass is mounted securely in the compass receiving cavity.

BRIEF DESCRIPTION OF THE DRAWINGS

Other features and advantages of the present invention will become apparent in the following detailed description of the preferred embodiment with reference to the accompanying drawings, of which.

DETAILED DESCRIPTION OF THE PREFERRED EMBODIMENT

Figure 1:
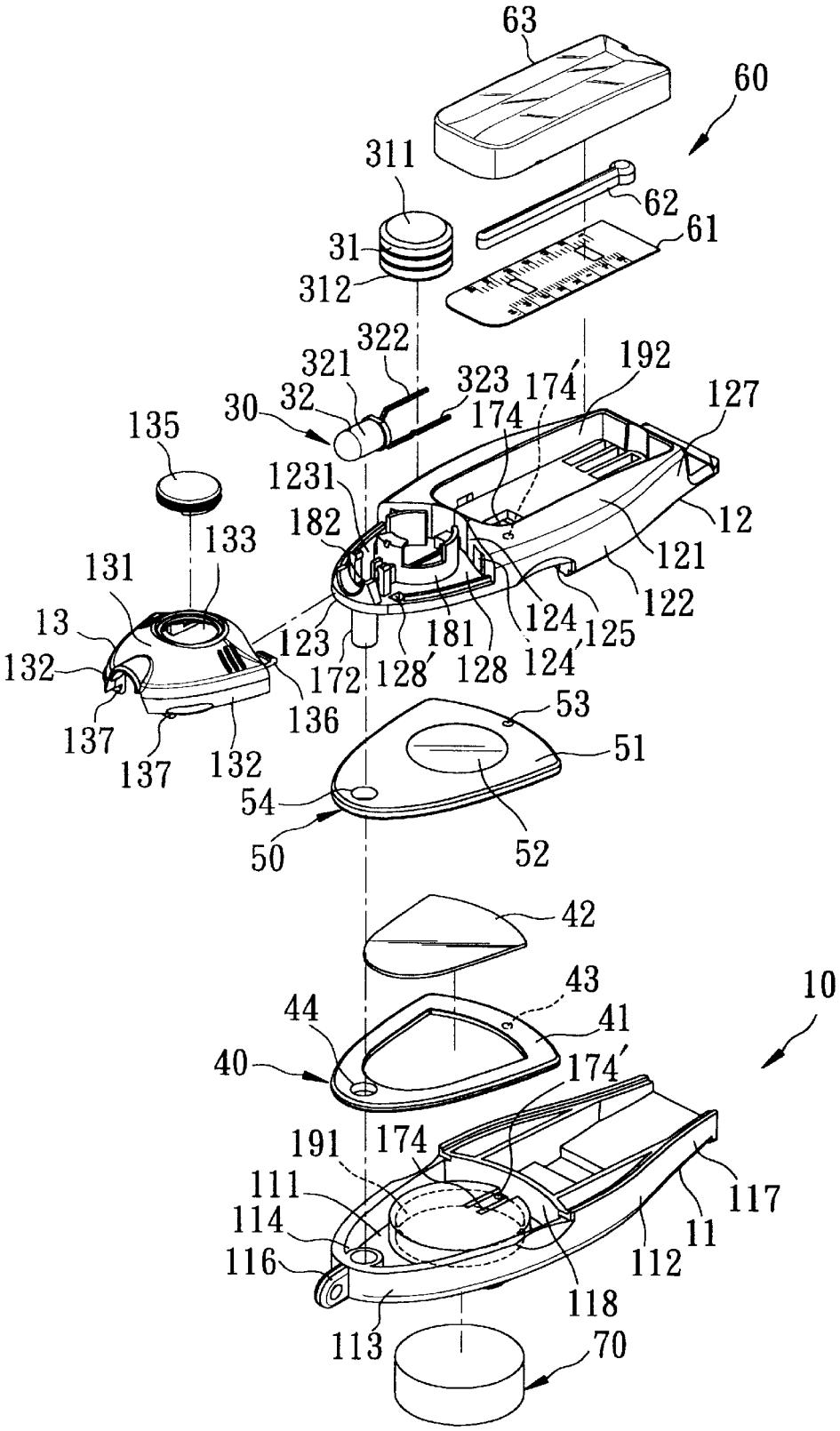
FIG. 1 is an exploded perspective view of the preferred embodiment of a multi-function handheld device according to the present invention.

Referring to FIGS. 1 to 4, the preferred embodiment of a multi-function handheld device according to the present invention is shown to comprise a casing unit 10, a torch unit 30, a planar mirror piece 40, a planar magnifying lens piece 50, a thermometer 60, and a compass 70. The casing unit 10 includes a lower casing member 11 and an upper casing member 12 mounted on top of the lower casing member 11. The lower and upper casing members 11, 12 are made of plastic, such as ABS plastic, and are bonded integrally to each other, such as with the use of known high frequency bonding techniques. Each of the upper and lower casing members 12, 11 has a rear casing part 122, 112 and a front casing part 123, 113 that extends forwardly from the rear casing part 122, 112 in a longitudinal direction. The lower casing member 11 includes a bottom wall 111 and a lower peripheral wall 117 that extends in the transverse direction from a periphery of the bottom wall 111. The lower peripheral wall 117 is formed to be higher at the rear casing part 112 than at the front casing part 113. The upper casing member 12 includes a top wall 121 and an upper peripheral wall 127 that extends in the transverse direction from a periphery of the top wall 121, and has a complementary construction with respect to the lower casing member 11. The upper peripheral wall 127 is formed to be longer in the transverse direction at the rear casing part 122 than at the front casing part 123. The lower and upper peripheral walls 117, 127 are connected securely to each other. In this embodiment, each of the upper and lower casing members 12, 11 further includes a partition wall 125, 118 that cooperates with the top and bottom walls 121, 111 and the upper and lower peripheral walls 127, 117 so as to confine an air chamber 16.

Figure 4:
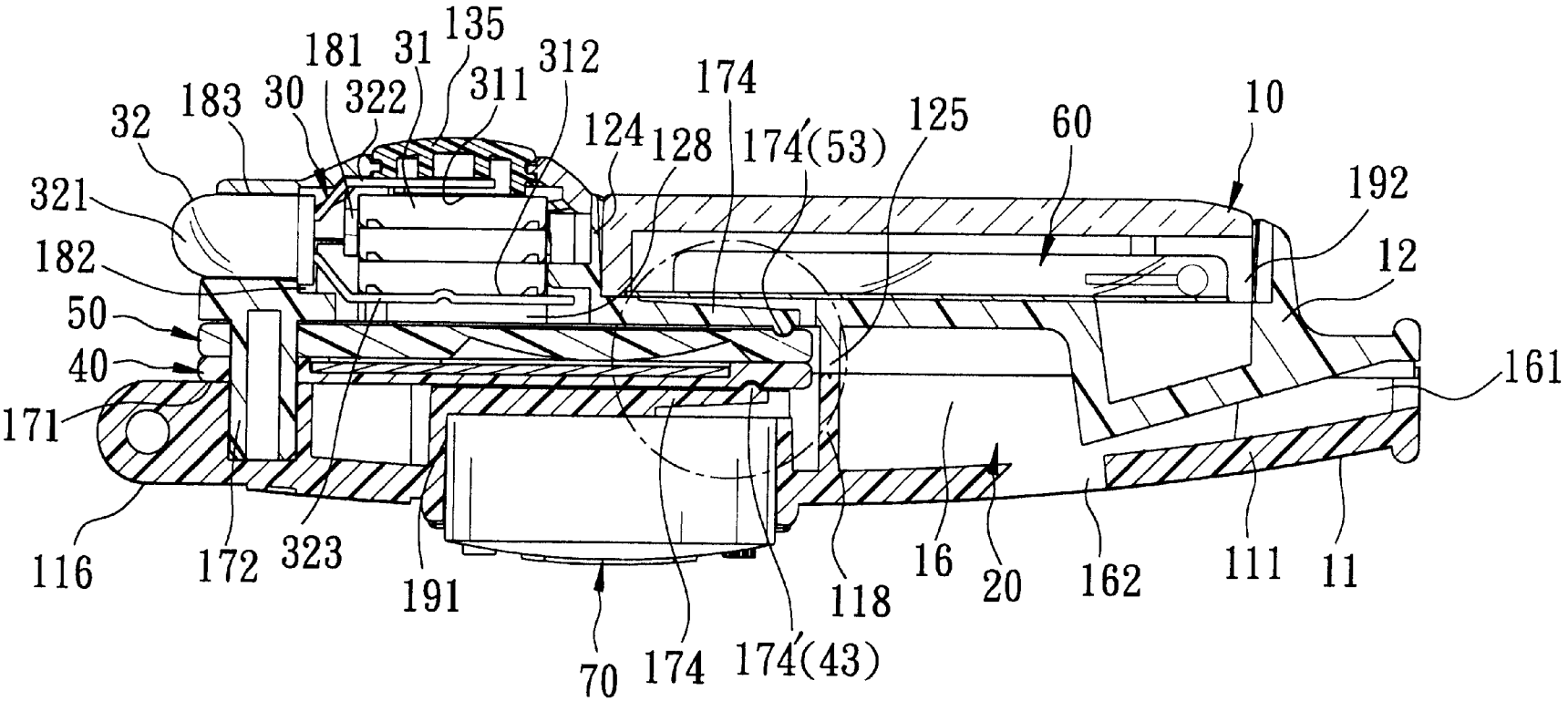
FIG. 4 is a longitudinal sectional view of the preferred embodiment taken along line 4—4 of FIG. 3.

The rear casing parts 112, 122 have rear ends that are distal to the front casing parts 113, 123 and that cooperatively define an air inlet 161 in the longitudinal direction so as to be adapted to permit blowing of air into the air chamber 16. The rear casing part 112 of the lower casing member 11 is further formed with an air outlet 162 that is disposed transverse to the longitudinal direction and that is adapted to permit releasing of the air that was blown into the air chamber 16, thereby permitting generation of a whistling sound output. The air inlet 161, the air outlet 162, and the air chamber 16 cooperate to define a whistle unit 20, as best illustrated in FIG. 4.

The front casing parts 123, 113 are parallel to each other, and are spaced apart in the transverse direction so as to define a receiving slit 171 therebetween. The top side of the front casing part 113 of the lower casing member 11 is formed with a mounting socket 114 that is registered with the receiving slit 171. The bottom side of the front casing part 123 of the upper casing member 12 is formed with a pivot stub 172 that engages the mounting socket 114. The mounting socket 114 and the pivot stub 172 are disposed at front ends of the front casing parts 113, 123 of the lower and upper casing members 11, 12 that are distal to the air inlet 161 in the longitudinal direction. The top side of the front casing part 123 of the upper casing member 12 has a torch support seat 182 at the front end, a vertical plate 124 spaced apart from the torch support seat 182 in the longitudinal direction, and a bottom support plate 128 between the torch support seat 182 and the vertical plate 124. Each lateral end of the vertical plate 124 is.formed with an insert hole 124'. Each lateral end of the bottom support plate 128 is formed with a lug hole 128'.

Figure 2:
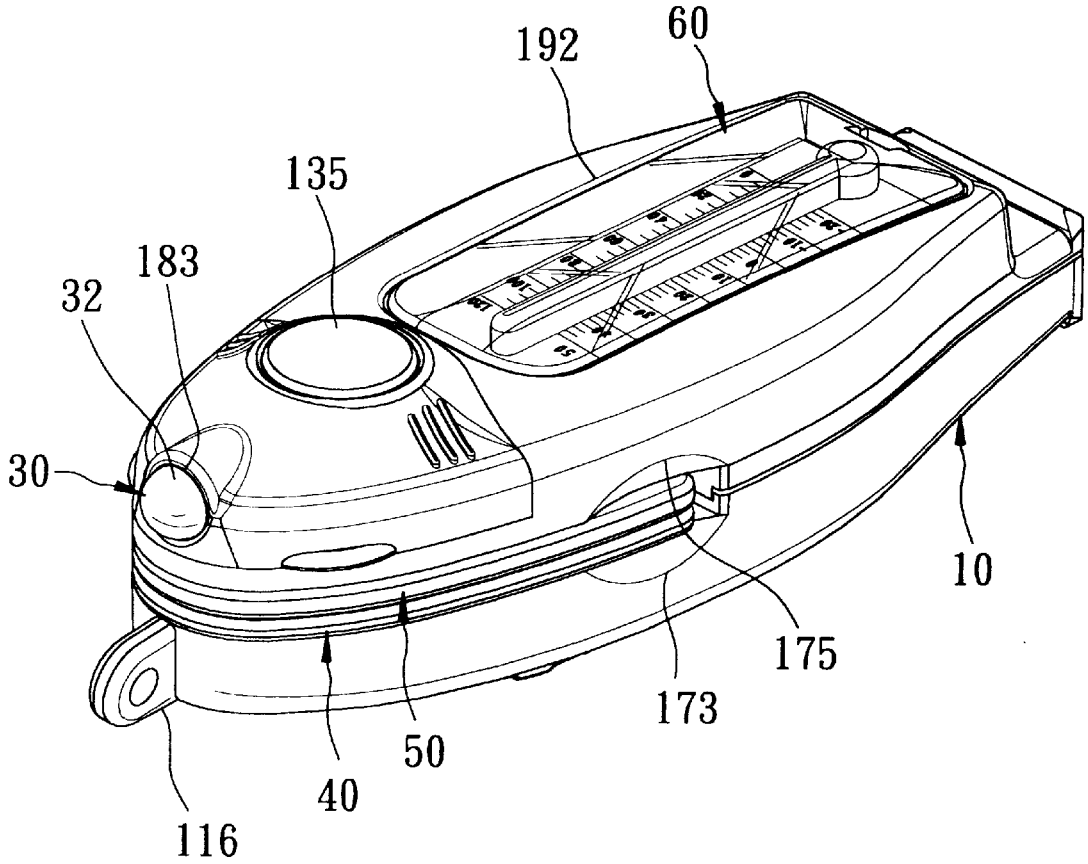
FIG. 2 is an assembled perspective view of the preferred embodiment.
Figure 3:
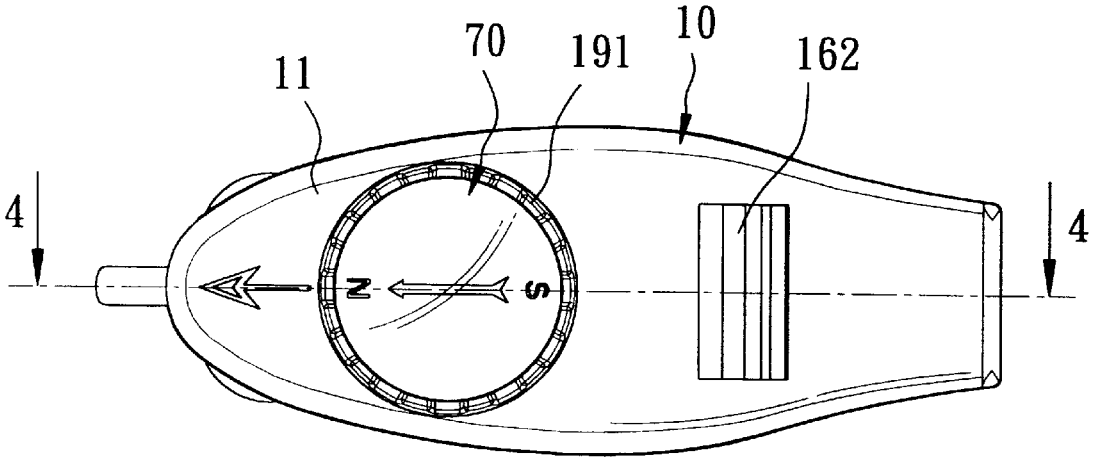
FIG. 3 is a schematic bottom view of the preferred embodiment, illustrating a compass mounted on a bottom side of a casing unit.

The upper casing member 12 further includes a cover body 13 mounted removably on the top wall 121 of the front casing part 123. The cover body 13 is formed with a lamp hole 183 that is opposite to the air inlet 161 in the longitudinal direction, a curved top plate 131 extending rearwardly from the lamp hole 183, and two opposite side plates 132 extending downwardly from the top plate 131. The top plate 131 has a center receiving hole 133, and a rear end side distal to the lamp hole 183 and formed with two fastening ribs 136. Each of the fastening ribs 136 engages resiliently a respective one of the insert holes 124'. Each of the side plates 132 has a bottom part formed with a lug 137 that extends downwardly and that engages a respective one of the lug holes 128', thereby retaining the cover body 13 on the top side of the front casing part 123 of the upper casing member 12, as best illustrated in FIGS. 1 and 2. The cover body 13 cooperates with the top wall 121 of the front casing part 123 so as to confine a torch receiving chamber 1231.

The casing unit 10 further has an outer wall surface formed with a thermometer receiving cavity 192 and a compass receiving cavity 191. In this embodiment, the thermometer receiving cavity 192 extends in the longitudinal direction, and is formed in a top side of the rear casing part 122 of the upper casing member 12. The compass receiving cavity 191 is formed in a bottom side of the front casing part 113 of the lower casing member 11. The lower casing member 11 is further provided with a lateral ring projection 116.

The torch unit 30 is disposed in the torch receiving a chamber 1231, and includes a battery set 31, a lamp member 32, and a press member 135. The torch receiving chamber 1231 has a battery seat 181 that is disposed on the bottom support plate 128 and that is adjacent to the torch support seat 182. The battery set 31 consists of a plurality of button cells connected in series, with the positive battery terminal 311 disposed at the top end and the negative battery terminal 312 disposed opposite to the positive battery terminal 311 at the bottom end. In this embodiment, the lamp member 32 is formed from a number of differently colored light emitting diodes. The lamp member 32 has a negative lamp terminal 323 in electrical contact with the negative battery terminal 312, and a positive lamp terminal 322 that extends adjacent to and that is normally spaced apart from the positive battery terminal 311. The lamp member 32 further projects out of the torch receiving chamber 1231 via the lamp hole 183. The press member 135 is made from a flexible plastic material, is mounted in the receiving hole 133 of the cover body 13, and is operable so as to urge the positive lamp terminal 322 to contact the positive battery terminal 311, thereby making electrical connection between the positive lamp terminal 322 and the positive battery terminal 311.

The planar mirror piece 40 is disposed in the receiving slit 171, and has a peripheral frame portion mounted pivotally on the pivot stub 172. The mirror piece 40 includes a first plate body 41 and a mirror plate 42 that is disposed on top of the first plate body 41 and that is made from stainless steel. The first plate body 41 has a front edge section formed with a first pivot hole 44 and a rear edge section formed with a first retention hole 43.

The planar magnifying lens piece 50 is disposed in the receiving slit 171 parallel to the mirror piece 40, and has an edge portion mounted pivotally on the pivot stub 172. The lens piece 50 includes a second plate body 51 and a magnifying lens 52 secured to the second plate body 51. The second plate body 51 has a front edge section formed with a second pivot hole 54 and a rear edge section formed with a second retention hole 53.

Figure 5:
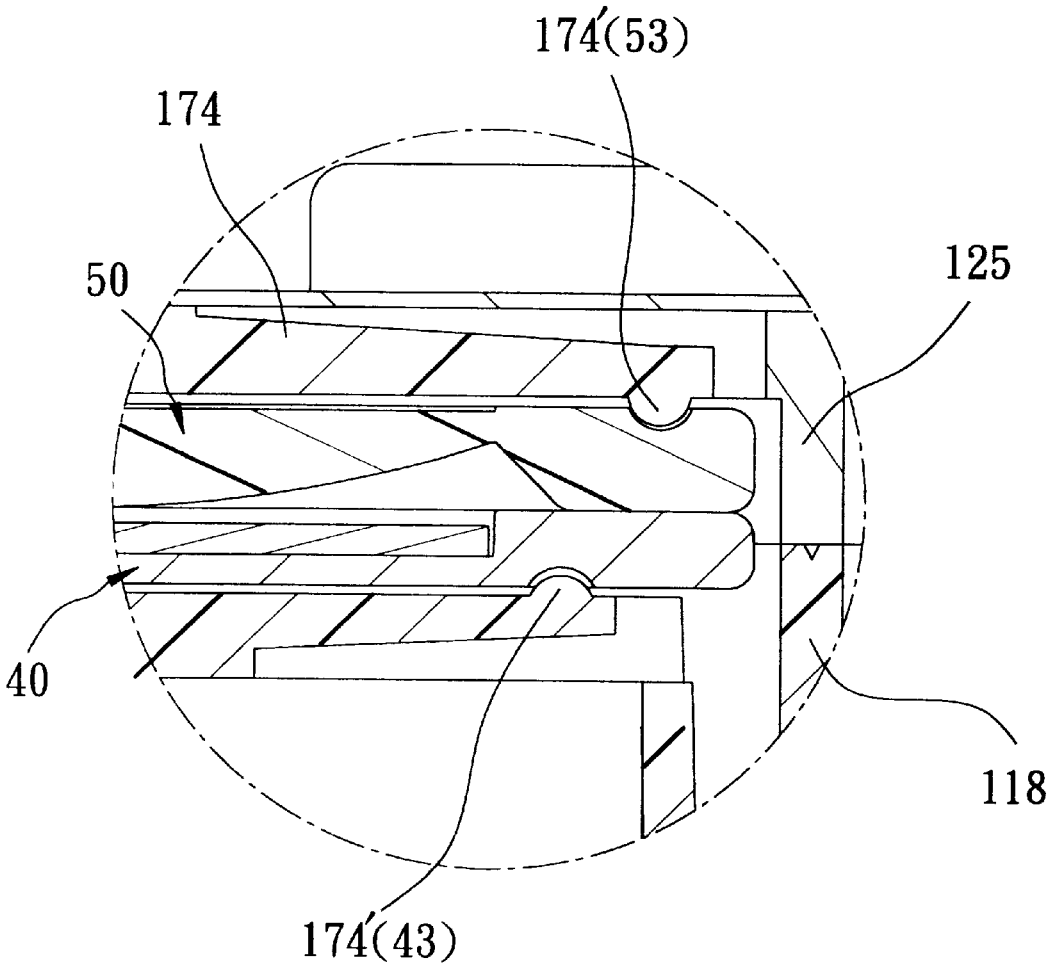
FIG. 5 is an enlarged fragmentary sectional view of an encircled portion in FIG. 4 to illustrate how a mirror piece and a magnifying lens piece are secured in the casing unit.
Figure 6:
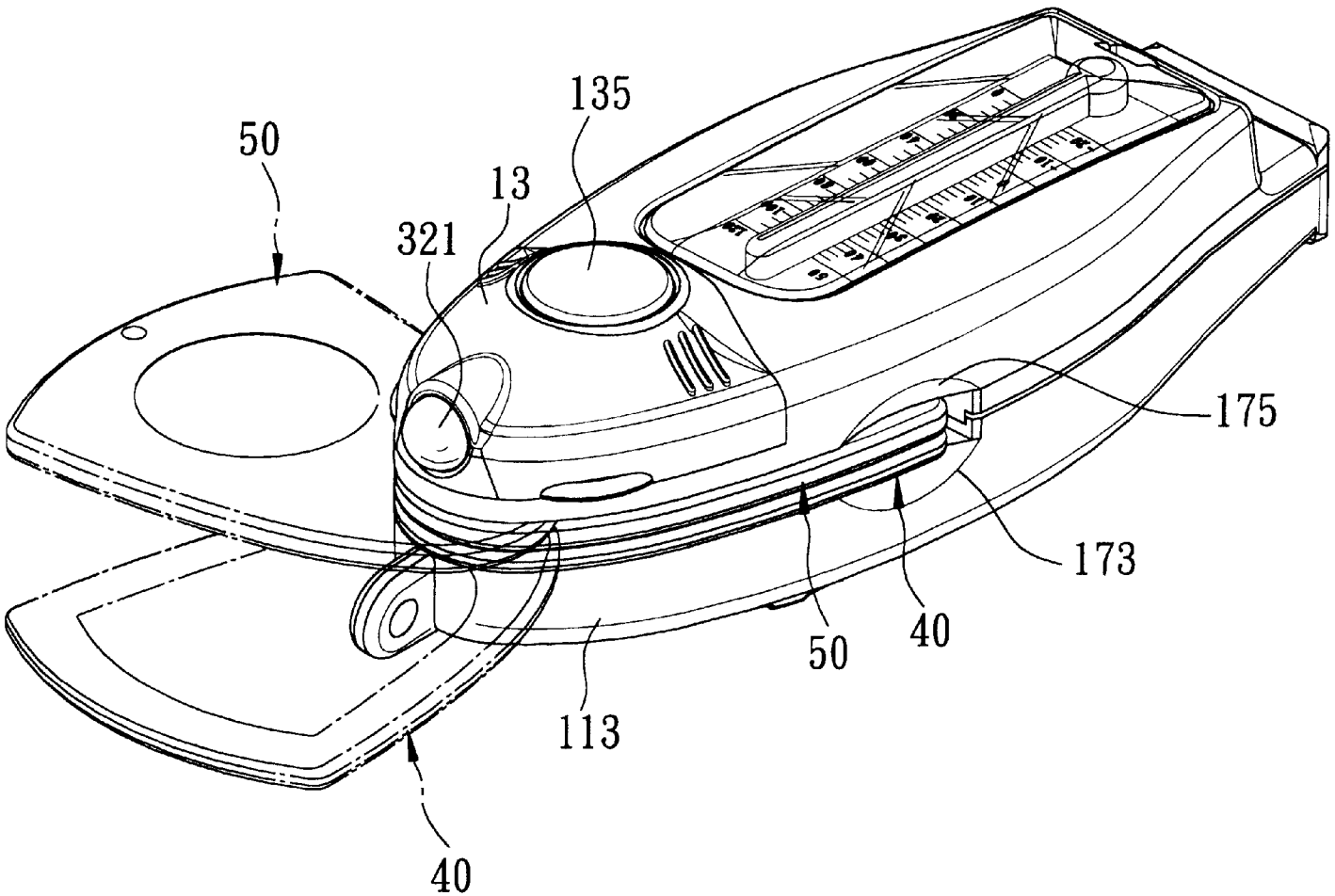
FIG. 6 is a perspective view illustrating the preferred embodiment in a state of use.

Each of the mirror piece 40 and the lens piece 50 is movable between a concealed position and an exposed position. In the concealed position, a corresponding one of the mirror piece 40 and the lens piece 50 is confined between the front casing parts 123, 113 of the upper and lower casing members 12, 11. In the exposed position, the corresponding one of the mirror piece 40 and the lens piece 50 is exposed from the front casing parts 123, 113 of the upper and lower casing members 12, 11. In this embodiment, the pivot stub 172 extends through the second pivot hole 54 in the lens piece 50, the first pivot hole 44 in the mirror piece 40, and engages the mounting socket 114, thus permitting three hundred and sixty-degree rotation of the lens piece 50 and the mirror piece 40 relative to the front casing parts 123, 113, as best illustrated in FIG. 6. The front casing part 113, 123 of each of the lower and upper casing members 11, 12 has a notched periphery 173, 175 to facilitate moving of an adjacent one of the mirror piece 40 and the lens piece 50 from the concealed position to the exposed position. The bottom side of the top wall 121 and the top side of the bottom wall 111 are each provided with a resilient unit 174. The resilient unit 174 is formed with a projection 174'. The retention hole 53, 43 in each of the lens piece 50 and the mirror piece 40 engages the projection 174' on the resilient unit 174 of the adjacent one of the top and bottom walls 121, 111 for retaining releasably the lens piece 50 and the mirror piece 40 at the concealed position, as best shown in FIG. 5.

The thermometer 60 is mounted securely in the thermometer receiving cavity 192, such as with the use of an adhesive, and includes a graduated plate 61, a capillary rod 62 secured to the graduated plate 61, and a transparent cover 63 to protect the thermometer 60. The graduated plate 61 and the capillary rod 62 cooperate to indicate the ambient temperature in a known manner.

The compass 70 is mounted securely in the compass receiving cavity 191, such as with the use of an adhesive, to indicate direction.

Referring back to FIGS. 2 to 4, during assembly, the mirror piece 40 and the magnifying lens piece 50 are pivotally connected to the pivot stub 172 between the lower and upper casing members 11, 12 before integrally bonding the latter. The thermometer 60 and the compass 70 are then secured in the thermometer receiving cavity 192 and the compass receiving cavity 191, respectively. Finally, the battery set 31 is mounted on the battery seat 181, and the lamp member 32 is mounted on the torch support seat 182, such that the positive and the negative lamp terminals 322, 323 are positioned relative to the positive and negative battery terminals 311, 312. The cover body 13 is pressed downwardly after engaging the fastening ribs 136 into the insert holes 124' so as to permit engagement of the lugs 137 within the lug holes 128', thereby retaining the cover body 13 on the upper casing member 12.

Referring back to FIGS. 4 and 5, under normal circumstances, the mirror piece 40 and the magnifying lens piece 50 are retained in the receiving slit 171 by virtue of the engagement between the retention holes 53, 43 and the projections 174' of the resilient units 174. Air blown through the air inlet 161 will result in a whistling sound output from the whistle unit 20. The thermometer 60 and the compass 70 can give indication of the ambient temperature and direction, respectively. Operation of the press member 135 activates the lamp member 32 to produce a light output. By virtue of the notched peripheries 173, 175, the mirror piece 40 and the magnifying lens piece 50 can be pivoted to the exposed position for use. The mirror piece 40 can reflect the light output of the lamp member 32 when disposed at the exposed position for signalling purposes.

In the event of an emergency, the whistle unit 20 can be blown to produce a whistling sound output, and the torch unit 30 can be used to attract other people's attention. When one gets lost, the mirror piece 40 can be used to reflect and flicker the sunlight to attract other people's attention, and the compass 70 can be used to find the right direction. The thermometer 60 can indicate changes in temperature so that appropriate attire can be worn. The ring projection 116 can be hooked or tied to a chain to form a keychain.

It has thus been shown that the handheld device of this invention incorporates the whistle unit 20, the torch unit 30, the mirror piece 40, the magnifying lens piece 50, the thermometer 60 and the compass 70 without incurring a substantial increase in its dimensions to facilitate carrying and use. The object of the invention in is thus met.

While the present invention has been described in connection with what is considered the most practical and preferred embodiment, it is understood that this invention is not limited to the disclosed embodiment but is intended to cover various arrangements included within the spirit and scope of the broadest interpretation so as to encompass all such modifications and equivalent arrangements.

I claim:

1. A multi-function handheld device comprising:

a casing unit including a lower casing member and an upper casing member mounted on top of said lower casing member, each of said lower and upper casing members having a rear casing part and a front casing part that extends forwardly from said rear casing part in a longitudinal direction, said rear casing parts of said lower and upper casing members cooperatively confining an air chamber, and having rear ends that are distal to said front casing parts and that cooperatively define an air inlet in the longitudinal direction so as to be adapted to permit blowing of air into said air chamber, said rear casing part of said lower casing member being further formed with an air outlet that is disposed transverse to the longitudinal direction and that is adapted to permit releasing of the air that was blown into said air chamber, thereby permitting generation of a whistling sound output, said front casing part of said upper casing member being formed with a torch receiving chamber, said front casing parts of said upper and lower casing members being parallel to each other and being spaced apart in the transverse direction so as to define a receiving slit therebetween, said front casing part of one of said upper and lower casing members being formed with a mounting socket that is registered with said receiving slit, said front casing part of the other one of said upper and lower casing members being formed with a pivot stub that engages said mounting socket, said casing unit further having an outer wall surface formed with a thermometer receiving cavity and a compass receiving cavity;

a torch unit disposed in said torch receiving chamber and including a battery set having a first battery terminal and a second battery terminal opposite to said first battery terminal, a lamp member having a first lamp terminal in electrical contact with said first battery terminal, and a second lamp terminal that extends adjacent to and that is normally spaced apart from said second battery terminal, and a press member mounted on said front casing part of said upper casing member and operable so as to urge said second lamp terminal to contact said second battery terminal and make electrical connection between said second lamp terminal and said second battery terminal;

a planar mirror piece disposed in said receiving slit and having a peripheral frame portion mounted pivotally on said pivot stub;

a planar magnifying lens piece disposed in said receiving slit and parallel to said mirror piece, said lens piece having an edge portion mounted pivotally on said pivot stub;

each of said mirror piece and said lens piece being movable between a concealed position, where a corresponding one of said mirror piece and said lens piece is confined between said front casing parts of said upper and lower casing members, and an exposed position, where the corresponding one of said mirror piece and said lens piece is exposed from said front casing parts of said upper and lower casing members;

a thermometer mounted securely in said thermometer receiving cavity; and a compass mounted securely in said compass receiving cavity, wherein the compass receiving cavity is located at the bottom of the lower casing member, below the torch unit, the magnifying lens, and the planar mirror piece.

2. The multi-function handheld device as claimed in claim 1, wherein said lower and upper casing members are made of plastic and are bonded integrally to each other.

3. The multi-function handheld device as claimed in claim 1, wherein:

said lower casing member includes a bottom wall and a lower peripheral wall that extends in the transverse direction from a periphery of said bottom wall; and said upper casing member includes a top wall and an upper peripheral wall that extends in the transverse direction from a periphery of said top wall;

said lower and upper peripheral walls being connected securely to each other.

4. The multi-function handheld device as claimed in claim 3, wherein said casing unit further includes a partition wall that cooperates with said top and bottom walls and said upper and lower peripheral walls so as to confine said air chamber.

5. The multi-function handheld device as claimed in claim 3, wherein said upper casing member further includes a cover body mounted removably on said top wall, said cover body cooperating with said top wall so as to confine said torch receiving chamber, said press member being mounted movably on said cover body.

6. The multi-function handheld device as claimed in claim 5, wherein said cover body is formed with a lamp hole that is opposite to said air inlet in the longitudinal direction, said lamp member projecting out of said torch receiving chamber via said lamp hole.

7. The multi-function handheld device as claimed in claim 1, wherein said front casing part of each of said lower and upper casing members has a notched periphery to facilitate moving of an adjacent one of said mirror piece and said lens piece from the concealed position to the extended position.

8. The multi-function handheld device as claimed in claim 1, wherein said pivot stub is disposed at front ends of said front casing parts of said lower and upper casing members that are distal to said air inlet in the longitudinal direction.

9. The multi-function handheld device as claimed in claim 3, wherein said thermometer receiving cavity extends in the longitudinal direction and is formed in a top side of said top wall.

10. The multi-function handheld device as claimed in claim 3, wherein said compass receiving cavity is formed in a bottom side of said bottom wall.

11. The multi-function handheld device as claimed in claim 1, wherein said casing unit is formed with a lateral ring projection.

12. A multi-function handheld device comprising:

a casing unit including a lower casing member and an upper casing member mounted on top of said lower casing member, each of said lower and upper casing members having a rear casing part and a front casing part that extends forwardly from said rear casing part in a longitudinal direction, said rear casing parts of said lower and upper casing members cooperatively confining an air chamber, and having rear ends that are distal to said front casing parts and that cooperatively define an air inlet in the longitudinal direction so as to be adapted to permit blowing of air into said air chamber, said rear casing part of said lower casing member being further formed with an air outlet that is disposed transverse to the longitudinal direction and that is adapted to permit releasing of the air that was blown into said air chamber, thereby permitting generation of a whistling sound output, said front casing part of said upper casing member being formed with a torch receiving chamber, said front casing parts of said upper and lower casing members being parallel to each other and being spaced apart in the transverse direction so as to define a receiving slit therebetween, said front casing part of one of said upper and lower casing members being formed with a mounting socket that is registered with said receiving slit, said front casing part of the other one of said upper and lower casing members being formed with a pivot stub that engages said mounting socket, said casing unit further having an outer wall surface formed with a thermometer receiving cavity and a compass receiving cavity;

a torch unit disposed in said torch receiving chamber and including a battery set having a first battery terminal and a second battery terminal opposite to said first battery terminal, a lamp member having a first lamp terminal in electrical contact with said first battery terminal, and a second lamp terminal that extends adjacent to and that is normally spaced apart from said second battery terminal, and a press member mounted on said front casing part of said upper casing member and operable so as to urge said second lamp terminal to contact said second battery terminal and make electrical connection between said second lamp terminal and said second battery terminal;

a planar mirror piece disposed in said receiving slit and having a peripheral frame portion mounted pivotally on said pivot stub;

a planar magnifying lens piece disposed in said receiving slit and parallel to said mirror piece, said lens piece having an edge portion mounted pivotally on said pivot stub;

each of said mirror piece and said lens piece being movable between a concealed position, where a corresponding one of said mirror piece and said lens piece is confined between said front casing parts of said upper and lower casing members, and an exposed position, where the corresponding one of said mirror piece and said lens piece is exposed from said front casing parts of said upper and lower casing members;

a thermometer mounted securely in said thermometer receiving cavity; and a compass mounted securely in said compass receiving cavity, wherein when the mirror piece and the lens piece are at the concealed position, the mirror piece and the lens piece are located between the torch unit and the compass receiving cavity to minimize the dimension of the handheld device.

13. The multi-function handheld device as claimed in claim 1, wherein the press member is of a circular shape.

14. A multi-function handheld device comprising:

a casing unit including a lower casing member and an upper casing member mounted on top of said lower casing member, each of said lower and upper casing members having a rear casing part and a front casing part that extends forwardly from said rear casing part in a longitudinal direction, said rear casing parts of said lower and upper casing members cooperatively confining an air chamber, and having rear ends that are distal to said front casing parts and that cooperatively define an air inlet in the longitudinal direction so as to be adapted to permit blowing of air into said air chamber, said rear casing part of said lower casing member being further formed with an air outlet that is disposed transverse to the longitudinal direction and that is adapted to permit releasing of the air that was blown into said air chamber, thereby permitting generation of a whistling sound output, said front casing part of said upper casing member being formed with a torch receiving chamber, said front casing parts of said upper and lower casing members being parallel to each other and being spaced apart in the transverse direction so as to define a receiving slit therebetween, said front casing part of one of said upper and lower casing members being formed with a mounting socket that is registered with said receiving slit, said front casing part of the other one of said upper and lower casing members being formed with a pivot stub that engages said mounting socket, said casing unit further having an outer wall surface formed with a thermometer receiving cavity and a compass receiving cavity;

a torch unit disposed in said torch receiving chamber and including a battery set having a first battery terminal and a second battery terminal opposite to said first battery terminal, a lamp member having a first lamp terminal in electrical contact with said first battery terminal, and a second lamp terminal that extends adjacent to and that is normally spaced apart from said second battery terminal, and a press member mounted on said front casing part of said upper casing member and operable so as to urge said second lamp terminal to contact said second battery terminal and make electrical connection between said second lamp terminal and said second battery terminal;

a planar mirror piece disposed in said receiving slit and having a peripheral frame portion mounted pivotally on said pivot stub;

a planar magnifying lens piece disposed in said receiving slit and parallel to said mirror piece, said lens piece having an edge portion mounted pivotally on said pivot stub;

each of said mirror piece and said lens piece being movable between a concealed position, where a corresponding one of said mirror piece and said lens piece is confined between said front casing parts of said upper and lower casing members, and an exposed position, where the corresponding one of said mirror piece and said lens piece is exposed from said front casing parts of said upper and lower casing members;

a thermometer mounted securely in said thermometer receiving cavity; and a compass mounted securely in said compass receiving cavity, wherein the air chamber is located directly underneath the thermometer receiving cavity to minimize the dimension of the handheld device.

* * * * *